United States Patent [19]

Wittstock

[11] Patent Number: 4,742,651

[45] Date of Patent: May 10, 1988

[54] CONTROL DEVICE FOR THE PROCESSING PRESSURE ON LAPPING, HONING AND POLISHING MACHINES

[75] Inventor: Gerhard Wittstock, Uetersen, Fed. Rep. of Germany

[73] Assignee: Peter Wolters, Fed. Rep. of Germany

[21] Appl. No.: 872,236

[22] Filed: Jun. 9, 1986

[30] Foreign Application Priority Data

Jun. 10, 1985 [DE] Fed. Rep. of Germany ..... 3520713

[51] Int. Cl.[4] ..... B24B 49/08

[52] U.S. Cl. ..... 51/165.9; 51/111

[58] Field of Search ..... 51/165.9, 165.91, 111 R

[56] References Cited

U.S. PATENT DOCUMENTS

| | | | |
|---|---|---|---|
| 2,747,338 | 5/1956 | Hoare | 51/165.9 |
| 3,173,230 | 3/1965 | Bovensiepen | 51/111 R |
| 3,665,647 | 5/1972 | Weatherell | 51/165.9 |
| 3,848,365 | 11/1974 | Bovensiepen et al. | 51/165.9 |
| 4,616,447 | 10/1986 | Haas | 51/165.9 |

*Primary Examiner*—Harold D. Whitehead

*Attorney, Agent, or Firm*—Faegre & Benson

[57] ABSTRACT

A control device for the processing pressure on honing, lapping and polishing machines, in which the tool is driven by motor via a spindle which is in its turn rotatably and essentially axially fixedly supported in a bearing member which is movable in the direction of the axis of the spindle, in which furthermore a double-acting actuation device engages at the bearing member via resilient means, and in which finally an energy sensor measuring the processing pressure transmits actual pressure signals to a program control which, dependent on time, compares the actual pressure signals with different preset pressure signals and from the comparison of the pressure signals generates adjusting signals for the actuation device. At least the resilient means counteracting the own weight of the tool is formed by a pneumatic adjusting means which is connected to a pressure gas source via a control valve. An adjustable throttle arrangement is connected to the pneumatic adjusting means for the controlled venting of the adjusting means dependent on the adjusting signal of the program control.

13 Claims, 5 Drawing Sheets

CONTROL DEVICE FOR THE PROCESSING PRESSURE ON LAPPING, HONING AND POLISHING MACHINES

FIELD OF THE INVENTION

The invention relates to a control device for the processing pressure on lapping, honing and polishing machines, wherein the tool is driven by motor via a spindle which is in its turn rotatably and essentially axially fixedly mounted in a bearing member which is movable in the direction of the axis of the spindle, and wherein furthermore a double-acting actuation device engages the bearing member via resilient means, and wherein finally an thrust sensor measuring the processing pressure transmits actual pressure signals to a program control which dependent on time compares the actual pressure signals with the various preset pressure signals and from the comparison of the pressure signals generates adjusting signals for the actuation device.

BACKGROUND OF THE INVENTION

A control device of this type is known (German patent letter No. 2 950 881). The spindle is rotatably supported in a paraxial sleeve, which in its turn is supported in the bearing member for the spindle. The sleeve is adapted to be elastically deformed in at least one region and carries an elongation measuring strip the signals of which are compared with preset signals in a comparison device. The actual signals indicate the respectively prevailing processing pressure. The bearing member for the spindle is designed as a double-acting hydraulic piston which is displaceably supported in a cylinder fastened to the frame.

The known device suffers from some disadvantages.

The thrust sensor, it is true, is in a position to provide signals exactly in proportion to the processing pressure, however, it is very expensive in construction. Furthermore, the thrust sensor is not readily accessible and, therefore, the mounting thereof necessarily is very expensive and, in case repair work has to be carried out, also the demounting thereof involves considerable costs. Another disadvantage resides in that the adjustment of the tool is effected via a hydraulic drive. A hydraulic drive likewise is relatively expensive. Furthermore, a hydraulic drive constitutes a rigid system which in its effectiveness shows a relatively stiff charateristic.

So as to avoid undesired impairments of the workpiece surface, efforts are made in connection with machines for precise surface processing not to have the processing pressure build up suddenly, but gradually, while avoiding a too hard engagement; only after a certain time the tool, such as a lapping disc, for example, is to come to lie onto the workpiece with the rated pressure. On the other hand, the build-up of the processing pressure is to take place as quickly as possible, in order to reduce the production time. However, it is relatively difficult to obtain soft transitions in an attempt to avoid damage to the workpieces, especially if non-linear and non-uniform load curvatures, respectively, are to be followed. Owing to frictional resistances in the hydraulic drive and a characteristic hysteresis it causes problems with each new processing step to obtain an exactly reproducible pressure build-up. Only the latter ensures an optimum surface processing of the individual workpieces.

SUMMARY OF THE INVENTION

It is therefore an object of the invention to provide a control device for the processing pressure on lapping, honing and polishing machines, in which an exactly reproducible, impact-free and soft build-up of the processing pressure may be obtained with simple means, even if the required processing pressure has a non-linear course.

This object is attained in accordance with the invention in that at least the resilient means counteracting the own weight of the tool is formed by a pneumatic adjusting means which is connected to a pressure gas source via a control valve, and in that an adjustable throttling arrangement is connected to the adjusting means for controlled venting of the pneumatic adjusting means in dependence upon adjusting signals from the program control.

The spring, which may be an air spring, is designed if posible in such a manner that with the pneumatic adjusting means possibly completely vented the maximum working pressure is achieved. In this connection, the weight of the tool such as the lapping disc, for example, is to be taken into consideration. A lapping disc when new mostly weighs more than is necessary to apply the maximum processing pressure. In such a case, therefore, the pneumatic adjusting means must not be vented completely to atmospheric pressure.

In the non-operative position, the maximum pressure prevails in the pneumatic adjusting means so that the tool is situated at the greatest possible distance from the workpiece. With the aid of the controllable throttling arrangement, the pressure in the pneumatic adjusting means may be reduced to desired individual values. Since pneumatic adjusting means work almost free of friction, there are no shocks occurring when adjusting the tool, rather, the tool may be brought smoothly into the working position at the desired speed and with soft transitions. Due to the negligible frictional properties almost any hysteresis is eliminated, so that also with each repeated operational step the pressure build-up takes place with the same values. The control device according to the invention makes possible a surface processing with reproducible quality.

As already mentioned, it is a requirement with the said machine tools that the pressure be built up gradually up to the desired processing pressure. This build-up, therefore, is a function of time. In the program control, it may be programmed which desired pressure must be obtained within which time intervals. The thrust sensor constantly supplies the actual processing pressure which is compared with the respective preset pressure in the program control. The aerating and venting of the pneumatic adjusting means may be achieved via the gas pressure source and the throttling arrangement, respectively.

The program control may contain a time member in order to determine whether the desired processing pressure has been obtained in certain time intervals. Alternatively, the time which is required for the build-up of certain processing pressures may be adjusted via the throttling means. In this case, it is only established in the program control when the actual pressure reaches a predetermined preset pressure value. The time needed for this is adjusted by selection of corresponding throttle cross sectional areas which determine the adjusting speed. If, following this, an altered course of the pressure increase is desired, the program control will then provide a different constellation for the throttling arrangement, i.e. a different processing pressure curvature will be followed up to a further desired pressure value. With respectively altered values for the preset values subjected to operation pressure and adjusting speeds the curve aimed at for the processing pressure may be realized.

It may indeed by imagined to obtain a desired course of pressure in the pneumatic adjusting means through a change of the cross sectional area of one single throttle which is connected to the pneumatic adjusting means via a control valve. However, from an apparatus expenditure viewpoint it is simpler if, in accordance with an embodiment of the invention at least two preferably adjustable throttles are connected to the pneumatic adjusting means via control valves of their own. The one throttle having a relatively large flow cross sectional area, for example, serves to guarantee a lowering of the tool at a relatively high speed. The second throttle having a smaller cross sectional area may be employed in order to perform the adjusting movement at a lower adjusting speed from a certain point onward, so that the tool such as a lapping disc, for example, gets smoothly into engagement with the workpiece. This throttle may then also take care of a smooth build-up of the processing pressure in the first phase. Further throttles may, however, be provided, in order to provide the desired direction for the course of the pressure build-up. When the desired final pressure corresponding to the pressure of operation is sensed by the energy sensor, the venting of the pneumatic adjusting means is terminated, thereafter the processing pressure remains constant throughout the desired period of time.

It has already been mentioned that a single pneumatic adjusting means supplies exactly reproducible results as regards the pressure build-up. It is particularly advantageous if both resilient means are respectively formed by at least one pneumatic adjusting means and the second pneumatic adjusting means is connected to a preferably adjustable throttle via a control valve. In this manner, two precisely adjustable spring means are effective in opposed senses at the bearing member; they are essentially free of frictions, so that recurring values may be obtained for the processing pressure. Pneumatic adjusting cylinders, bellows type cylinders and similar pneumatic adjusting organs may serve as pneumatic adjusting means.

The interposition of a lever according to an embodiment of the invention offers the advantage that a desired speed ratio may be selected. Besides, it is also possible thereby to compensate a relatively small effective path of adjustment. It goes without saying that the fastening of the pneumatic adjusting means at the lever is such that only negligible friction will occur. The fastening of the other lever arm at the bearing constructional member must of course take into account that with the bearing member moved vertically the pivot point will become displaced. So, for instance, an elongated hole may be provided in the lever having a journal of the bearing member engaging therein.

Preferably, in accordance with a further embodiment of the invention, the thrust sensor is arranged between the pneumatic adjustment means and the lever. The thrust between the upper pneumatic adjusting means and the lever arm is at any time a measure for the processing pressure, as long as the latter is below the weight of the tool. If, however, a contact pressure is additionally exerted on the tool, the weight of the tool must be added when determining the processing pressure, provided the pressure in the upper pneumatic adjusting means is zero.

For technical reasons of production a quick throughput is desired so that apart from the net processing time possibly short times are desired for the adjustment and removal of the tool. The tool is therefore, if possible, approached quickly as far as a point shortly before engagement at the workpiece. But as the tool wears off, a purely time-dependent control of the speed will not lead to obtain the object aimed at. If the feed of the tool is performed at the beginning at a high speed with a strongly worn tool, the distance from the workpiece beginning at which a slower feed takes place, naturally, is much greater than with a tool which is not worn off, if in both cases the same time intervals are selected. Therefore, one embodiment of the invention provides that an interception switch fast with the frame is adapted to be actuated by the bearing member and the tool, respectively, which transmits a signal to the program control for the purpose of reducing the lowering speed, when the tool has approached the workpiece up to a predetermined measure. If possible, the interception switch should take the wear into account automatically. In this connection, another embodiment of the invention provides that an actuation rod is connected to the tool or the bearing constructional member, said rod having a holding member displaceably supported thereon which, in its turn may be selectively clamped at the actuation rod by means of an arresting mechanism connected to the program control, said holding member comprising an adjustable actuation member for the interception switch which is connected to the program control, said holding member cooperating with an abutment fixed to the frame in such a manner that with the holding member approaching the abutment the interception switch is actuated only when the actuation member is in its extended position. To adjust the interception switch, the tool is at first lowered onto the workpiece without being driven in the direction of rotation. The actuation member at the holding member is disposed in the retracted position. The holding member which is freely displaceable on the actuation rod, in this condition, is disposed on the abutment fixed to the frame. Prior to feeding the tool anew, the holding member is clamped tight. During the feeding operation, the actuation member is extended and actuates the switch shortly before the abutment is reached.

The preferably adjustable abutment is selected in such a manner that the actuation of the interception switch is taking place through the extended actuation member, when the tool has reached its minimum distance from the workpiece, which preferably is very small. Upon actuation of the interception switch the program control takes care that the feed of the tool is now performed with a much lower speed. Furthermore, a signal is issued for the retraction movement of the actuation member and detachment of the arresting mechanism so that the holding member may lower itself onto the abutment. When the tool is lifted after the processing operation, the arresting mechanism is actuated anew and moved into the lifted position. With the further processing operations, the steps as described are repeated.

The use of the interception switch is advantageous not only with a lever-mounted spindle. The interception switch may be employed also for conventional tool holding means.

As already explained, the time for feeding the tool is to be as short as possible. On the other hand, the build-up of the loading pressure on the workpieces is to take place according to a desired characteristic, which is also to be altered dependent on the processing conditions. In this connection, a further embodiment of the invention provides that for lowering the spindle and the tool, respectively, to a position shortly before the tool engages upon the workpieces, the upper adjusting means is vented via the control valve and the throttling means, that, upon this position being reached, the control valve of the upper adjusting means is closed and the control valve for aerating the lower adjusting means is opened, and that upon a predetermined loading pressure being reached both control valves are closed.

A desired pressure build-up may be obtained particularly in the region between a minimum loading pressure and the higher loading pressure by a corresponding pressure bias on the lower adjusting means. In doing so it is aimed at obtaining the minimum loading pressure within a relatively short period of time. Also the build-up of the final loading pressure from a higher loading pressure may take place very quickly.

The selectively adjustable pressure build-up between the lower and the higher loading pressure may take place in that the associated control valve is opened over a predetermined duration of time. A different opening time, however, will lead to a different duration and size of the loading pressure—with the provision that there is a predetermined flow cross sectional area of a throttle arranged between the control valve and the adjusting means. Only through an alteration of the throttle cross sectional area may a different linear characteristic be obtained with opening times being the same. In addition, it must be taken into consideration that different volumina in the lower adjusting means condition different switch-on times of the control valve, in order to obtain the same build-up of the loading pressure. Through wear of the tool the volume of the lower adjusting means may substantially increase, so that thereby also the duration of the feeding time will be substantially increased. Another embodiment of the invention, therefore, provides that the control valve between the lower and the higher loading pressure is cyclically opened with the aid of clock pulses from the program control, with the intervals of said clock pulses being variable. Greater intervals between the clock pulses are effective to cause the build-up of a lower pressure within a given time interval than with shorter intervals of the clock pulses. With the aid of changed clock pulse intervals it is possible in this arrangement to obtain a desired pressure build-up. The course of the pressure build-up need not absoutely be linear, i.e. it may also be progressive or degressive, for example. The clock pulses having selectively varied intervals are supplied from the program control, they may therefore be programmed in a memory of the programming control.

So that the desired characteristic for the build-up of the loading pressure remains the same even in case of wear of the tools and with altered workpiece heights, an embodiment of the invention provides that a way indicator is associated with the tool, the bearing member or the spindle; the prolongation of the way of the tool until it comes to touch upon the workpieces and until the interception switch becomes responsive, respectively, which is caused by the wear, is detected; and the intervals of the clock pulses are changed in dependence upon the prolongation of the way. As already mentioned, a prolongation of the way due to wear leads to an increase of volume in the lower adjusting means; the latter thus requires a greater amount of air to obtain the desired pressure in the adjusting means. With an increased volume, therefore, the intervals of the clock pulses are to be shortened, so that the pressure build-up may be obtained up to the desired loading pressure within an equal space of time.

With the aid of the last described embodiment it is possible with only one control valve and, optionally, a fixedly adjusted throttle to follow the most different curves of the loading build-up and, at the same time, compensate alterations in air volume caused by wear of the tool. Upon the higher loading pressure value being reached, a steep increase of the loading build-up usually takes place owing to the lower adjusting means being continuously connected to the pressure source and the upper adjusting means again being vented. Since this takes place very quickly and, consequently, minor deviations in the loading pressure because of a certain inertia of the control valves cannot be avoided, it is possible with the aid of the program control to re-approach to the desired preset value for the loading pressure by control pulses for the valve.

The program control, besides, is designed if possible in such a manner that the motor for the spindle is switched on when the lower loading pressure has been obtained. Thereby it is secured that the tool such as a working disc rests uniformly on all the workpieces, before it is set to motion.

The invention will be described in the following in more detail by way of drawings.

DETAILED DESCRIPTION OF THE PREFERRED EMBODIMENT

Figure 1:
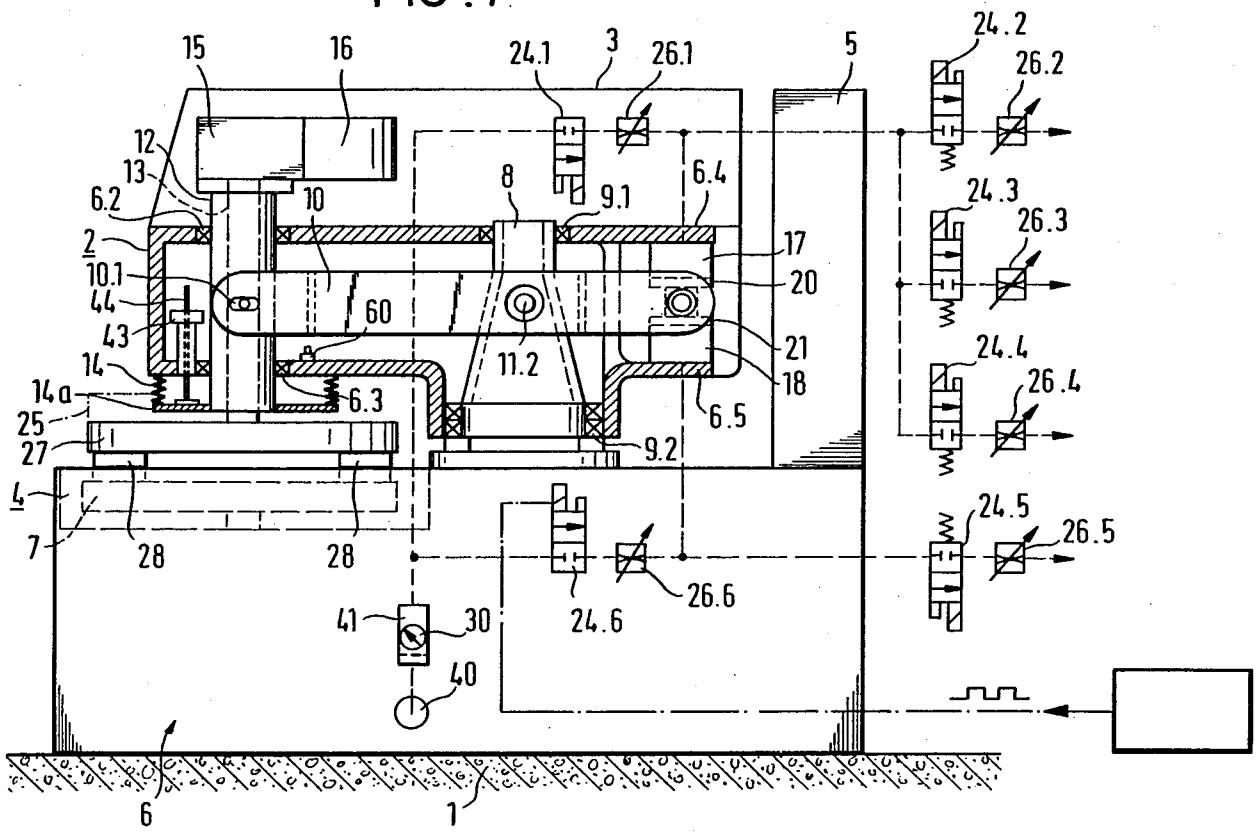
FIG. 1 shows a side view in a vertical section through a two-disc lapping machine, with a control device according to the invention.

Prior to enlarging in more detail on the individual representations shown in the drawings it is to be stated that each of the features described is of inventively essential importance by itself or in connection with features of the claims.

Figure 2:
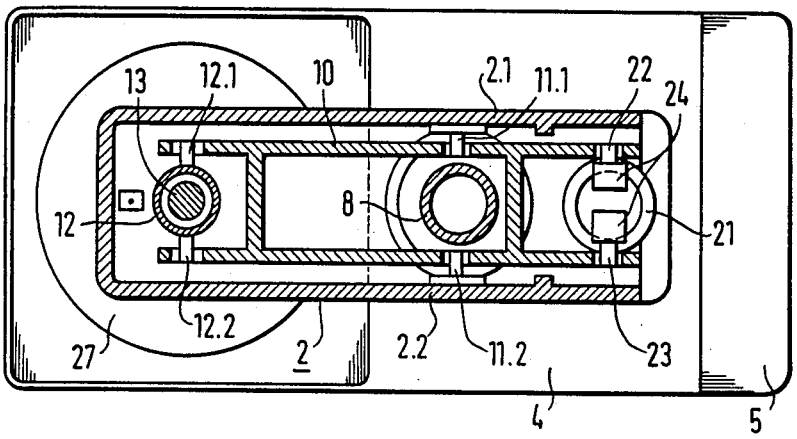
FIG. 2 shows a top plan view on the two-disc lapping machine according to FIG. 1 in a horizontal section.

The two-disc lapping machine shown in FIGS. 1 and 2, which rests on a foundation 1, subdivides into an upper portion 2 with bonnet 3 and a lower portion 4 with switch cabinet 5. The lower portion 4 comprises a frame 6 with the lower lapping disc 27 supported therein, including its drive (not shown). Seated on the frame 6 is the switch cabinet 5 and a pillar stand 8 for the upper portion 2. The upper portion 2 is pivotally supported at the pillar stand 8 in bearings 9.1 and 9.2. Arranged in the upper portion 2 is a double-armed lever 10 which is pivotally supported by means of pivot bearings 11.1 and 11.2 in the side wall 2.1 and 2.2 of the upper portion 2 (see FIG. 2). Formed at the end of the longer left arm of the lever 10 are elongated holes 10.1, in which the roller journals 12.1, 12.2 of a spindle sleeve 12 are accommodated. The spindle sleeve 12 supports a working spindle 13 with the aid of an upper and a lower ball bearing which are not shown in any more detail.

The spindle sleeve 12 is in its turn centered in sliding bearings 6.2, 6.3 of the upper portion 2, and axially guided. It projects downward beyond the upper portion. A protective bellows 14 which is closed in a downward direction by the disc **14*a* surrounding the spindle sleeve 12, serves to protect the lower bearing 6.3 and the spindle sleeve surface. At the upper end thereof, the spindle sleeve 12 carries a drive consisting of a transmission 15 and a motor 16. At the lower end of the spindle 13 an upper lapping disc is pivotally suspended in a manner known per se. Between the discs 7 and 27 workpieces 28** are processed in a manner known per se.

At the other end of the upper portion 2 oppositely disposed brackets 6.4 and 6.5 are formed with a pneumatic adjusting organ (for example, an adjusting cylinder or a bellows of suitable polymeric or metallic material) respectively supported thereat. The upper adjusting member is designated with 17 and the lower one with 18. Fitted at the other end of the pneumatic adjusting members 17, 18 are mounting plates 20, 21 which are connected via screws 24 to rotatable bearing journals 23. At least one rotary bearing, for instance, the one belonging to rotary bearing journal 23, is designed as an thrust or load sensor.

A source of compressed air 40 is connected to the upper pneumatic adjusting member 17 via a pressure regulator 41 with manometer 30, a control valve 24.1 and a throttle 26.1. The source of compressed air 40 is in addition connected to the lower adjusting member 18 via a control valve 24.6 and a throttle 26.6. Connected to the upper adjusting member 17 are in addition, in parallel, control valves 24.2, 24.3 and 24.4 which are in their turn connected to throttles 26.2, 26.3 and 26.4. The throttle cross sectional areas are adjustable. Connected to the lower adjusting member 18 is in addition a control valve 24.5 which is connected to a throttle 26.5. The throttles 26.2 to 26.5 are connected to the atmosphere.

Arranged in the upper portion 2, finally, is an interception switch 43 which is actuated by an actuation rod 44, which is connected to the disc **14*a*. The construction of the interception switch may be seen from FIGS. 4 to 6**.

The actuation rod 44 connected to the disc **14*a* extends through the lower wall of the upper portion 2 and through a supporting sleeve 46 which is arranged in the bore of the upper portion 2. An enlargement 47 at the upper end of the supporting sleeve 46 carries an electric switch 48 and an adjustable abutment 49 on the opposite side. Slidingly pushed onto the actuation rod 44 above the supporting sleeve 46 is a holding block 50. Seated in the holding block 50, as indicated by 51, is an adjusting cylinder the piston rod 52 of which cooperates with a wedging key 53*a* seated in a paraxial longitudinal groove of rectangular cross section in the actuation rod 44. When the adjusting cylinder 51 is actuated, the holding block 50 is tightly clamped to the actuation rod 44**.

Figure 4:
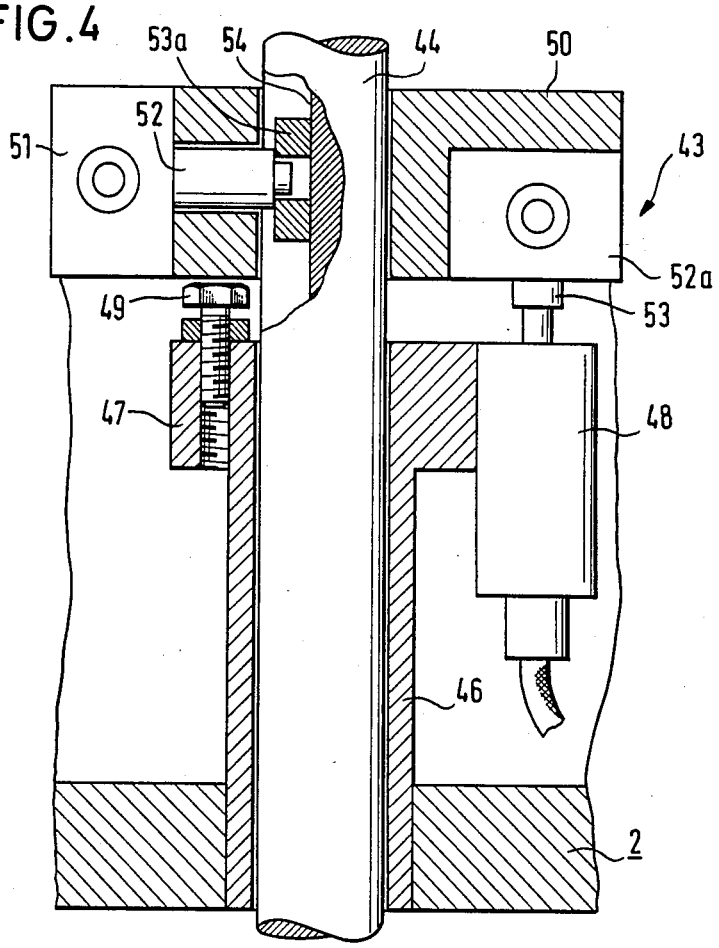
FIG. 4 shows a cross sectional view of an intercepting switch for the control device according to the invention.
Figure 5:
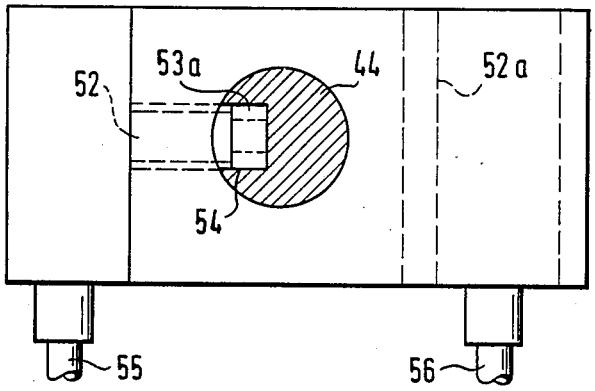
FIG. 5 shows a top plan view taken on the holding member of the intercepting switch according to FIG. 4.
Figure 6C:
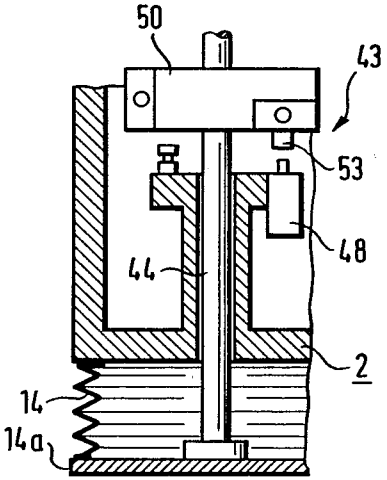
FIGS. 6*a* to 6*c* show different positions of an interception switch in connection with the respective position of the upper lapping disc.
Figure 6B:
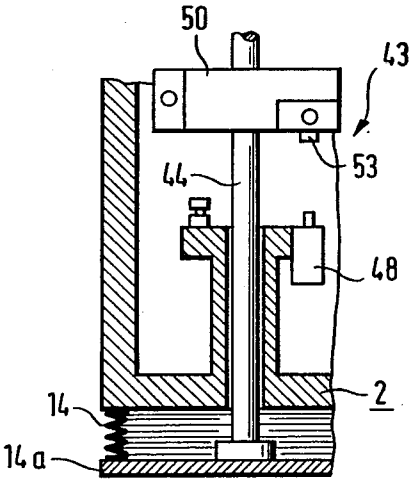
Figure 6A:
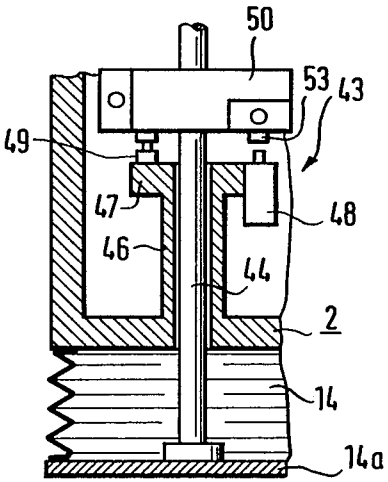

Furthermore seated at the holding block 50 is a switching cylinder **52*a*, the piston rod of which carries a switching cam 53. Said switching cam is shown in FIGS. 4, 6*a* and 6*b* in the retracted position, while in FIG. 6*c* it is represented in the extended position. When the holding block 50 lies in close contact against the abutment 49 and when the switching cam 53 is retracted, the switch 48 is not actuated. The adjusting cylinders 51 and 52*a* are connected to a suitable source of hydraulic or pneumatic energy as indicated respectively at 55 and 56**.

Figure 7:
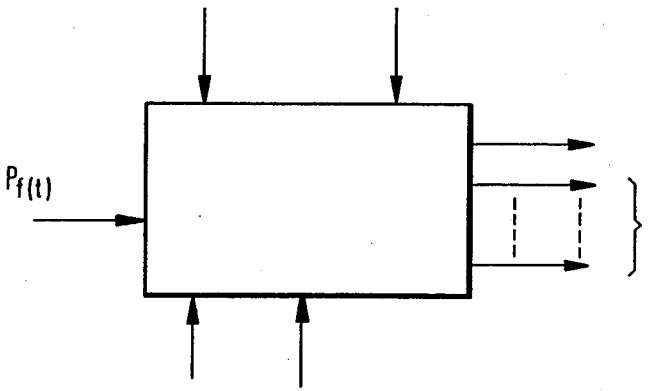
FIG. 7 shows in an extremely diagrammatical representation the control diagram of the control device according to the invention.

The lapping machine as shown is controlled by a program control (see FIG. 7). The individual operational steps are stored in the program control, especially the speed when feeding the upper lapping disc 27, the processing pressure thereof in dependance upon the time, the processing time, the possible re-processing time, as well as the automatic resetting of the lapping disc for the removal of the workpieces and charging with new workpieces.

For this purpose, the program control receives the signals from the interception switch 43, from the sensor 23, and a travel or way indicator 60 fast with the frame which cooperates with the lever 10. In the present example it does not measure the entire path of adjustment of the lever but only the distance approximately, which the working disc 27 covers with respect to the position in which it gets into engagement with the workpieces in its new, i.e. its unworn condition.

Figure 3:
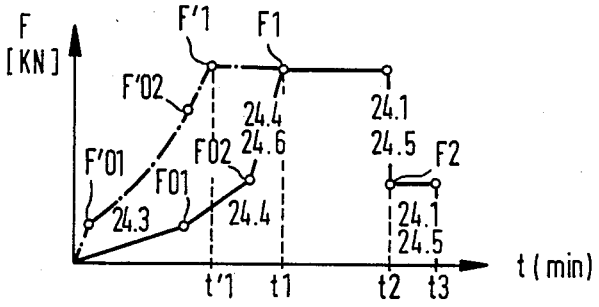
FIG. 3 shows a typical loading diagram with a lapping machine according to FIGS. 1 and 2.

FIG. 3 shows two energy/time diagrams showing over time the processing pressure as exerted on the workpieces 28 by the lapping disc 27. During the time up to t1 and t'1, respectively, the touching down of the lapping disc 27 and the gradual application of the processing pressure takes place during three linear phases. During the time from t1 to t2 and from t'1 to t2, respectively, the processing step proper takes place with the desired operational pressure. At the point in time t2, the operational pressure is more or less abruptly reduced to a predetermined percentage. The processing during the time from t2 to t3 correspondingly takes place with a reduced operational pressure. At the point in time t3 the operational pressure is abolished.

The mode of operation of the control device as described is as follows.

After the machine has been charged with the workpieces 28 in a known manner and the upper portion 2 has been pivoted back into the working position, the feed of the lapping disc 27 begins, which is situated in the uppermost position as indicated at 25 in FIG. 1 and shown indirectly in FIG. **6*b*. With the lapping disc in the uppermost position, the upper adjusting member 17 is connected to the pressure source 40 via the opened control valve 24.1. Control valve 24.5 is likewise opened, so that the lower adjusting member is vented. The remaining valves are closed. When a switching command ON is introduced into the program control (see FIG. 7), the control valve 24.1 will close, and the control valve 24.2 will be opened by the program control. Via throttle 26.2 which is dimensioned to have a relatively large cross sectional area, the upper adjusting member 17 is quickly vented, so that the upper lapping disc 27 due to its own weight may descend relatively quickly. To accelerate the lowering step, the valves 24.3 and 24.4 may also be opened, so that their throttles 26.3 and 26.4** disposed in parallel take care of a still quicker venting. The lowering step and the build-up of pressure normally take place fully automatically via the program control. In the course of the pressure shown in FIG. 3 in dash-dotted lines the first lower pressure value F'01 is obtained relatively quickly with the curve showing a steep course. The lower pressure value is 250N, for example.

To adjust the interception switch 43 the upper lapping disc 27 is gently brought to touch upon the workpieces 28 by manual control, until the lapping disc 27 rests thereon under a slight pressure which is indicated via the thrust sensor. During this step, the holding block 50 is displaceably supported at the actuation rod 44 through a corresponding actuation of the adjusting cylinder 51, and the adjusting cylinder 52*a* retains the switching cam 53 in the retracted position. The holding block 50, therefore, rests upon the adjustable abutment 49. Following this, the holding block 50 is tightly clamped to the actuation rod 44, and the lapping disc is again run upwards via the interception point. The actuation of the individual control valves during the upward movement will be enlarged upon later on in this description.

The lapping disc 27 is now fed anew in the manner as described above, with the holding block seated tightly at the actuation rod 44 and the switching cam 53 extended. The stroke of the switching cam 53 as well as the position of the contact of the switch 48 are such that an actuation of the switch 48 takes place just before the holding block 50 strikes upon the abutment 49. This position is shown in FIG. 6*c*. Up to this point the lowering of the lapping disc 27 takes place at a relatively high speed in the manner as described above. The switch signal is used in the program control to close the control valve 24.2 and open the control valve 24.3. The effective cross sectional area of the throttle 26.3 is substantially smaller than that of throttle 26.2, so that now the venting of the upper adjusting organ 17 takes place correspondingly more slowly and, thus, also the lowering speed of the lapping disc 27 is very slow. The lapping disc, therefore, touches upon the workpieces 28 very gently. The signal of the switch 48 is also used to release the holding block 50 from its clamping engagement with the actuation rod 44 and to again return the switching cam 53 into the retracted position (see FIG. 6*a*). Thereby, the holding block 50 comes again to lie upon the abutment 49. It will be noted that on the ground of the construction of the interception switch 43 as described the distance of the lapping disc 27 from the workpiece 28, beginning at which the lowering of the disc 27 at a reduced speed takes place, is independent of the amount by which the lapping disc 27 is worn off. The size of the distance may be adjusted by the adjustable abutment 49.

The increasing venting of the upper adjusting organ 17 via the throttle 26.3 leads to an increase of the processing pressure along the first portion of the curve of increase according to FIG. 3, up to Fo1 and F'01, respectively. The ascent of the curve of this section is determined by the opening cross sectional area of the throttle 26.3, which may be varied. When on the curve shown in full lines the pressure Fo1 is obtained, which is transmitted via the thrust sensor to the program control, the latter takes care of a closure of the valve 24.3 and an opening of the valve 24.4. The appertaining throttle 26.4 thereof has a greater cross sectional area than the throttle 26.3, so that the increase of the processing pressure takes place along a steeper section of the curve. If the load sensor reports the pressure Fo2 to the program control, the valve 24.6 will be opened, so that the lower adjusting organ 18 is vented. Owing thereto, a steep increase of the pressure takes place. When the pressure F1 is obtained, the program control closes all the control valves and takes care that the pressure F1 is maintained over the period of time from t1 to t2. The driving motor 16 for the spindle 13 is switched on only when the energy sensor reports a minimum pressure to the program control, such as Fo1, for example. Thereby it is secured that the lapping disc 27 snugly rests upon the workpieces 28, before it is rotated. This minimum pressure may, for instance, be 250N. Only after this pressure has been reached, will the motor 16 be switched on, and the lapping disc 27 begins to rotate.

In case the lapping disc 27 always would have the same weight, the differential pressure prevailing between the adjusting organs 17, 18, would be proportional to the processing pressure. However, the weight of the lapping disc 27 changes considerably in the course of time due to wear. Therefore, a corresponding correction must be carried out for the program control. For this purpose, the weight of the lapping disc is newly measured at each processing step. This is performed shortly before the lapping disc 27 touches upon the workpieces 28. The pressure prevailing in the upper adjusting organ 17 is proportional to the force engaging at the other lever arm. As all the components that are to be carried by the lever 10, remain the same in weight with the exception of the lapping disc, the force respectively measured at a certain point at the adjusting member 17 constitutes a measure for the weight of the lapping disc 27. By means of this weight signal the corresponding values in the program control may always be corrected and brought to the latest level. The taring of the lapping disc 27 takes place automatically, so that the services of any operating personnel are not required.

The build-up of the processing pressure may also be effected in a modified manner. This build-up shall be explained by way of the curve shown in dash-dotted lines in FIG. 3. The lowering of the lapping disc 27 prior to becoming seated on the workpiece takes place in the manner as described above.

The lowering of the lapping disc to become seated and the increase of the processing pressure up to a minimum loading pressure F'01 takes place within a relatively short period of time.

For this purpose, the control vlave 24.1 is closed shortly before the seating operation, and the lower adjusting organ 18 is connected to the pressure source 40 via the control valve 24.6. This is performed in such a manner that the control valve 24.6 is clocked via the program control, i.e. is respectively switched on and off by pulses. The distance between the clock pulses determines for a given interval the amount of air which flows into the adjusting member 21 at the given pressure of the pressure source 40. By changing the distances of the clock pulses, thus, it is possible to control this amount of air and, along with it, the build-up of pressure in the adjusting organ 18 in any manner that may be desired. The build-up of the loading pressure of the lapping disc 27, therefore, may take place in any manner that may be desired between the pressure values F'01 and F'02.

It goes without saying that the loading pressure F'02 may also assume other absolute values. After the higher loading pressure F'02 has been obtained, the control valve 24.6 is continuously opened. Furthermore, the control valve 24.2 is opened, in order to vent the upper adjusting organ 17. In this manner, a quick pressure increase takes place up to the final loading pressure F'1. On the ground of the quick increase, it is possible that minor deviations may occur in the loading due to the inertia of the valves. Therefore, a re-clocking is once more effected to the preset value F'1 with the aid of the program control.

As already mentioned, the wear of the lapping disc 27 increases its path, whereby also the volume of the adjusting member 18 increases. If there was no change taking place in the supply of compressed air to the adjusting organ, a wear would lead to an altered course of the loading curve, especially between the points F'01 and F'02 The way indicator, however, detects the alteration of the way conditioned by the wear, and the program control compensates said alteration of the way by an alteration of the pulse intervals for the clock pulses for the control of the control valve 24.6. The wear is in this way completely compensated, so that a constantly reproducible loading pressure build-up is obtained.

It is often required that a processing with the desired operational pressure be followed by a re-processing with a reduced pressure. For this purpose, the valves 24.1 and 24.5 are opened. That means that a pressure is built up in the adjusting member 17 via the throttle 26.1, while the lower adjusting member 18 is vented via throttle 26.5. This operation takes place relatively quickly. If the reduced processing pressure F2 is reached, the valves will close again. The reprocessing takes place during the time from t2 to t3. Following this, the valves 24.1 and 24.5 are opened anew, and the lapping disc 27 moves into its uppermost position (see also FIG. 6*b*). The upper portion 2 may now be pivoted and permit the taking-out and charging of the workpieces. The new manufacturing step will then run off as described.

The apparatus as described was explained in more detail for a two-disc lapping machine only by way of example. It goes without saying that also a one-disc lapping machine, for example, may be controlled analogously. Furthermore, the control device is applicable also to honing and polishing machines. Finally, the advantageous construction of the interception switch is not restricted to the actuation of the spindle sleeve via the adjustment organs 17, 18, but may be used also for different feeding means, in which a compensation of wear is to take place.

I claim:

1. A control device for controlling the processing pressure on lapping, honing and polishing machines, in which a tool is driven by motor via a spindle which is in its turn rotatably and essentially axially fixedly supported in a bearing constructional member which is movable in the direction of the axis of the spindle, the device comprising:

(a) a double-acting actuation device for engaging the bearing constructional member by an automatic adjusting means, the automatic adjusting means having an upper pneumatic adjusting means and a lower pneumatic adjusting means, and the automatic adjusting means connected to a gas pressure source by a control valve and by another control valve is connected to an adjustable throttle;

(b) a thrust sensor for measuring the processing pressure of said tool on said workpiece and having means for transmitting pressure signals indicative of the processing pressure;

(c) a program control operatively coupled to the actuation device and the thrust sensor and which periodically compares the actual pressure signals from the thrust sensor with different preset pressure signals and from the comparison of the pressure signals generates adjusting signals for the actuation device;

(d) an adjustable throttle arrangement operatively connected to the double acting actuation device for the controlled venting of the adjusting means in response to the adjusting signal of the program control, said program control being constructed and arranged for lowering the spindle and the tool, respectively, to a position just before the tool touches down onto the workpieces and for venting the upper adjusting means by a control valve and the throttling arrangement, closing the control valve for the upper adjusting means, cyclically opening a control valve for the lowering adjusting means with the aid of clock pulses of the program control, the distances of the clock pulses being adapted to be altered, opening the control valve for venting the lower adjusting means upon reaching a higher loading pressure (F02, F'02) and closing both control valves upon reaching predetermined upper final loading pressure (F1, F'1); and (e) a travel indicator operatively coupled to the tool, the travel indicator detecting both the prolongation of the travel of the tool until the tool touches down onto the workpieces, the distances of the clock pulses changing in dependence upon the prolongation of the travel of the tool, and also the response of an interception switch, said switch adapted to be activated by the tool to transmit a signal to the program control for the purpose of decreasing the tool speed when the tool has approached the workpiece to a predetermined extent.

2. A device according to claim 1, further comprising at least two adjustable throttles connected to the double-acting actuation device by control valves of their own.

3. A device according to claim 1, wherein the bearing constructional member is suspended at one arm of a double-armed lever and the pneumatic adjusting means engages the other level arm.

4. A device according to claim 3, wherein said thrust sensor is arranged between the upper pneumatic adjusting means and one arm of said double-armed lever.

5. A device according to claim 1, further comprising:

(a) an actuated rod connected to the bearing constructional member;

(b) a holding member axially displaceably supported on said actuation rod and selectively adapted to be tightly clamped thereto by means of a locating mechanism connected to the program control; and (c) said holding member further comprising an adjustable actuation member adapted for having a retracted and extended position for actuating a switch connected to the program control, said switch actuated only when the actuation member is in the extended position.

6. A device according to claim 1, wherein upon deviation of the final loading pressure (F1, F'1) from the preset value after the control valves have been closed, the control valve for the lower adjusting means is cyclically opened by means of the clock pulses until the final loading pressure (F1, F'1) has finally reached the preset value.

7. A device according to claim 6, wherein the program control switches on the motor for the spindle when the lower loading pressure (F01, F'01) has been reached.

8. A control device for processing pressure on workpiece lapping, honing and polishing machines, comprising:

(a) a tool for effecting the workpiece;

(b) a motor drive having a spindle rotatably supported axially in a bearing construction member and movable in the direction of the axis of the spindle for driving the attached tool;

(c) a double-acting actuation device operatively coupled to a bearing constructional member by resilient means for applying tension by said tool on the workpiece; and (d) program control means for receiving adjustment signals and for varying the tension of said tool on the workpiece by effecting said double-acting actuation device responsive to said adjustment signals.

9. A device according to claim 8, said double-acting actuation device further comprising upper pneumatic adjusting means and lower pneumatic adjusting means operatively connected to a gas pressure source having a control valve and an adjustable throttle arrangement.

10. A device according to claim 9, wherein said program control means further comprises means for varying the tension of said tool on the workpiece by said double-acting actuation device having means for controlled venting of the gas pressure within said double-acting actuation device.

11. A device according to claim 8, wherein said thrust sensor further comprises a sensor arranged between engagement of said double-acting actuation device and said double-armed lever.

12. A device according to claim 8, further comprising an interception switch mounted on and adapted for transmitting adjustment signals to the program control, said adjustment signals effecting a decrease in speed of the lowering of the tool when the tool has approached the workpiece to a predetermined extent.

13. A device according to claim 9, wherein said program control is constructed and arranged to effect lowering of the spindle and the attached tool to a position just prior to engagement between the tool and the workpiece by venting the upper adjusting means.

* * * * *

UNITED STATES PATENT AND TRADEMARK OFFICE

CERTIFICATE OF CORRECTION

PATENT NO. : 4,742,651

DATED : May 10, 1988

INVENTOR(S) : Gerhard Wittstock

It is certified that error appears in the above—identified patent and that said Letters Patent is hereby corrected as shown below:

Column 6, line 65, the numeral appearing as "27" should read --7--.

Column 7, line 4, the word appearing as "wall" should read --walls--.

Column 7, line 20, the numeral "27" should appear after the word "disc" and before the word "pivotally".

Signed and Sealed this

Twenty-ninth Day of November, 1988

*Attest:*

DONALD J. QUIGG

*Attesting Officer*

*Commissioner of Patents and Trademarks*